US008240821B2

(12) United States Patent
Brooks

(10) Patent No.: US 8,240,821 B2
(45) Date of Patent: Aug. 14, 2012

(54) INK CARTRIDGE REFILLING

(76) Inventor: Christopher John Brooks, Stoke-on-Trent (GB)

( * ) Notice: Subject to any disclaimer, the term of this patent is extended or adjusted under 35 U.S.C. 154(b) by 922 days.

(21) Appl. No.: 12/282,592

(22) PCT Filed: Mar. 9, 2007

(86) PCT No.: PCT/GB2007/000818

§ 371 (c)(1),
(2), (4) Date: Oct. 28, 2008

(87) PCT Pub. No.: WO2007/104937

PCT Pub. Date: Sep. 20, 2007

(65) Prior Publication Data

US 2009/0066734 A1 Mar. 12, 2009

(30) Foreign Application Priority Data

Mar. 11, 2006 (GB) ..... 0604965.4

(51) Int. Cl.
*B41J 2/175* (2006.01)

(52) U.S. Cl. ..... 347/85

(58) Field of Classification Search ..... 347/85, 347/86, 87, 89, 84

See application file for complete search history.

(56) References Cited

U.S. PATENT DOCUMENTS

| | | | |
|---|---|---|---|
| 5,709,253 | A | 1/1998 | Maerzke |
| 6,158,851 | A | 12/2000 | Zepeda |
| 6,170,938 | B1 | 1/2001 | Kenyon |
| 2002/0097306 | A1 | 7/2002 | Deshmukh |
| 2005/0146570 | A1 | 7/2005 | Hilton |
| 2005/0248638 | A1 | 11/2005 | Suzuki et al. |
| 2006/0028515 | A1 | 2/2006 | Hermes et al. |

FOREIGN PATENT DOCUMENTS

| | | |
|---|---|---|
| DE | 9207758 | 9/1992 |
| EP | 1607224 | 12/2005 |

*Primary Examiner* — Kristal Feggins
(74) *Attorney, Agent, or Firm* — Chernoff, Vilhauer, McClung & Stenzel

(57) ABSTRACT

Apparatus for refilling and subsequently sealing an ink jet cartridge. The apparatus including a body with a pointed distal end which can be pushed through a tape covering the fill hole for the cartridge. A recess is provided in the proximal end of the apparatus for connection to a syringe or a feed pipe. A passage connects with the recess and also a radial passage adjacent the distal end of the apparatus. A resilient sleeve locates in a circumferential recess extending around the apparatus and covering the end of the passage in a rest condition to provide a one way valve.

15 Claims, 1 Drawing Sheet

INK CARTRIDGE REFILLING

This is a national stage application filed under 35 USC 371 based on International Application No. PCT/GB2007/000818 filed Mar. 9, 2007, and claims priority under 35 USC 119 of United Kingdom Patent Application No. 0604965.4 filed Mar. 11, 2006.

This invention concerns apparatus usable for refilling an ink cartridge, a method of refilling an ink cartridge, and particularly but not exclusively a cartridge for an ink jet printer.

Ink jet cartridges are often refilled with ink following use. However, with some cartridge configurations it is difficult to fully fill the cartridge and expel air therefrom.

According to one aspect of the present invention there is provided apparatus usable for refilling an ink cartridge and subsequently sealing the cartridge, the apparatus including a body sealingly locatable in a fill hole of an ink cartridge, and a one way valve arrangement to permit fluid to flow through the fill hole into the cartridge, but not thereoutof.

The body may have a pointed distal end to permit the body to penetrate a seal over the fill hole as the body is pushed thereinto. A flange may be provided around the proximal end of the body, engageable around the perimeter of the fill hole.

A recess may be provided in the proximal end of the body to receive a supply member for ink to refill the cartridge. The recess may have a Luer slip configuration.

The body is preferably dimensioned so as to slidingly sealingly fit in the fill hole.

The valve arrangement may include one or more generally radial openings in the body which connect to the proximal end of the body. A resilient member may surround the or each radial opening, and in a relaxed condition the resilient member may close the or each radial opening. The resilient member may be in the form of a sleeve or an O ring.

Alternatively, the valve arrangement may include a movable member located in the body which member is spring urged to close an opening to close the arrangement, but which member can be moved against the spring urging to allow fluid to pass into the cartridge.

As a further alternative the valve arrangement may include a duck bill seal.

According to a further aspect of the invention there is provided a method of refilling an ink cartridge, the method including locating apparatus according to any of the preceding seven paragraphs in the fill hole of a cartridge, and passing ink through the apparatus into the cartridge.

The ink may be supplied to the apparatus at above ambient pressure.

The delivery valve of the cartridge may be held open during filling to permit air to pass out of the cartridge therethrough. Below ambient pressure may be applied to the cartridge delivery valve during refilling.

The apparatus may remain in the fill hole following refilling.

The apparatus may be used to initially break a seal over the fill hole.

The ink may be supplied by a syringe, the distal end of which may sealingly locate in the recess. Alternatively, the ink may be supplied through a feed pipe, the distal end of which may sealingly locate in the recess.

According to a still further aspect of the invention there is provided a method of refilling an ink cartridge, the method including forming a seal around or in the fill hole of a cartridge, passing ink through the seal into the cartridge with the delivery valve of the cartridge held open, and with the ink being passed into the cartridge at above ambient pressure, and/or below ambient pressure being applied to the cartridge delivery valve.

The ink may be supplied by a syringe with a gasket provided around the distal end of the syringe. Alternatively, the ink may be supplied through a feed pipe with a gasket provided around the distal end of the feed pipe.

The fill hole may be resealed following refilling.

A still further aspect of the invention provides a method of refilling a cartridge for an ink jet printer, the method being according to any of the preceding nine paragraphs.

Embodiments of the present invention will now be described by way of example only, and with reference to the accompanying drawings, in which.

Figure 1:
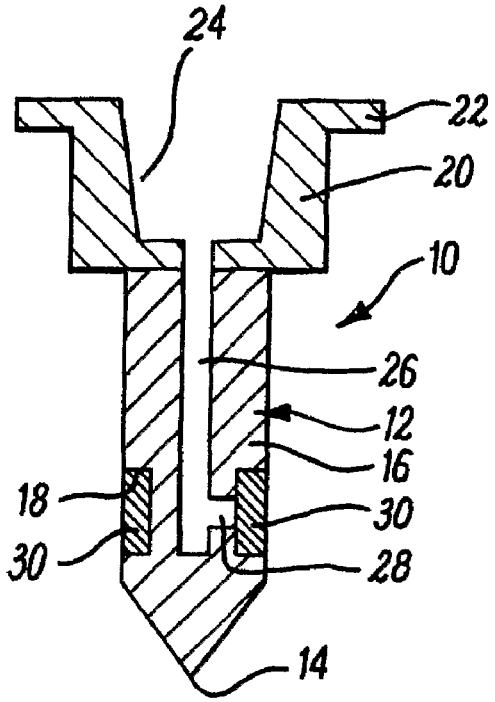
FIG. 1 is a diagrammatic cross sectional view of a first apparatus according to the invention.

FIG. 1 shows a first apparatus 10 according to the invention for use in refilling and subsequently sealing ink cartridges, and particularly ink jet cartridges. The apparatus 10 includes a body 12 with a pointed distal end 14. Extending proximally from the distal end 14 there is provided a first cylindrical part 16 of the body 12 with a circumferential recess 18 adjacent its distal end. The first cylindrical part 16 extends proximally to a second cylindrical part 20 of greater diameter, which has a proximal annular flange 22.

An inwardly tapering axial recess 24 is provided in the flange 22 and second cylindrical part 20 which provides a Luer slip formation. The recess 24 connects with a coaxial narrow central passage 26 extending into the first cylindrical part 16. The passage 26 connects with a radial passage 28 which extends outwardly into the circumferential recess 18.

A resilient annular sleeve 30 locates in the recess 18, and in a relaxed condition closes the radial passage 28. The sleeve 30 acts as a one way valve in preventing fluid moving proximally through the apparatus 10. However fluid moving distally will move the sleeve 30 off the end of the passage 28, and hence permit fluid to pass therethrough.

In use the apparatus 10 may be used in refilling a cartridge for an ink jet printer as follows. The pointed distal end 14 is pushed through a tape covering a fill hole for the cartridge. The second cylindrical part 20 provides a sliding sealing fit in the fill hole, and the apparatus 10 is pushed into the fill hole until the flange 22 engages around the perimeter of the hole. The apparatus closes the fill hole but the one way valve arrangement provided by the sleeve 30, means that if ink is supplied into the axial passage 26, the ink can push past the resilient sleeve 30.

In practice to fill a cartridge it is generally necessary to hold open the delivery valve to allow air in the cartridge to exit therethrough as ink enters the cartridge. It is also usually required to either supply the ink to the apparatus at an elevated pressure and/or to apply reduced pressure to the delivery valve. Otherwise it is generally not possible to fully fill the cartridge and remove the air therefrom. The ink may be supplied from a syringe or a feed pipe.

Figure 2:
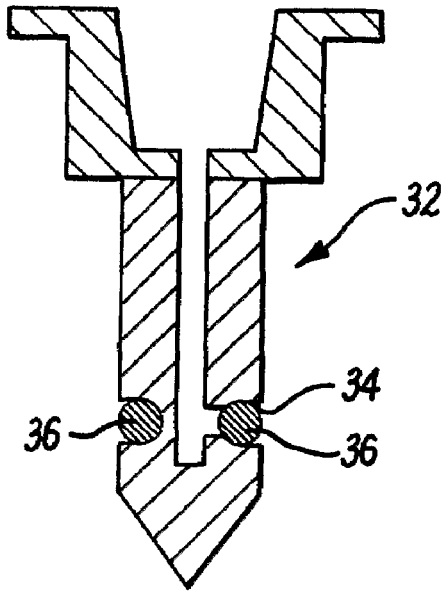
FIG. 2 is a similar view to FIG. 1 but of a second apparatus according to the invention.

FIG. 2 shows a generally similar second apparatus 32 except that a shorter circumferential recess 34 is provided, and this locates an O ring 36 which acts as a one way valve arrangement in a similar way to the sleeve referred to above.

Figure 3:
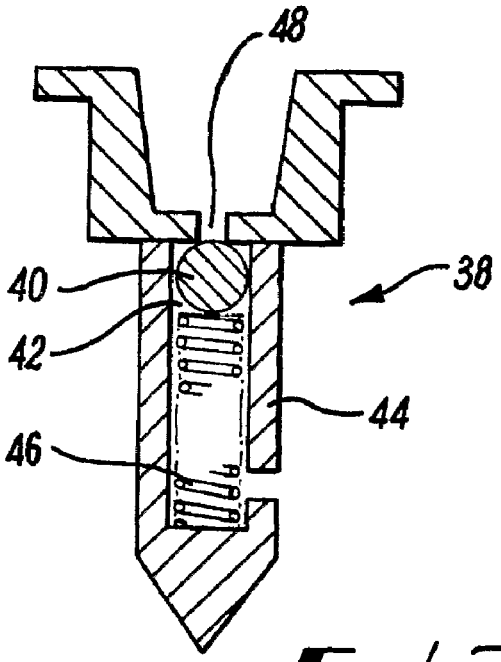
FIG. 3 is a similar view to FIG. 1 but of a third apparatus according to the invention.

FIG. 3 shows a third apparatus 38 usable in a similar manner. However, in this instance the one way valve arrangement is provided by a trapped ball bearing 40 which is located within a cylindrical recess 42 within the first cylindrical part 44 of the body, and is urged by a spring 46 to close an axial opening 48 at the proximal end of the part 42. In use a distal flow of ink into the apparatus 38 will move the ball bearing 40 against the spring 46, and thus permit ink to flow through the apparatus 38.

Other valve arrangements could be used. For instance a duck bill valve may be provided on a carrier, which carrier seals the fill hole. No pointed distal end would be provided with such an arrangement, such that alternative means must be used for breaking the seal over the fill hole.

There are thus described apparatus usable in filling an ink cartridge and also subsequently sealing the cartridge. The apparatus described are of generally simple form, and can thus be inexpensively manufactured for long term multiple use. The invention also provides a method of refilling cartridges, which otherwise may be difficult to fully refill.

Various other modifications may be made without departing from the scope of the invention. For instance, the above described examples can be made of a number of different materials including plastics or metal, and the first described example is made for instance from nylon by injection moulding.

Whilst using the above described apparatus to refill a cartridge has found to be advantageous, the invention also covers refilling a cartridge other than with this apparatus. It is required that ink is delivered into the cartridge at above ambient pressure, and/or below ambient pressure is applied to the delivery valve. This ensures the whole of the cartridge is filled, and also that the cartridge is primed to deliver ink from the delivery valve when required.

This can be achieved by providing a seal in or around the fill hole, which can be accomplished by a syringe or a feed pipe with a gasket or other seal means on its distal end. The gasket may be of a size to sealingly locate in or around the fill hole. The delivery valve will again be held open, with the possibility of applying reduced pressure thereto. Following refilling the fill hole is resealed, for instance by placing a strip of adhesive tape thereover.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. Apparatus usable for refilling an ink cartridge and subsequently sealing the cartridge, the apparatus including a body sealingly locatable in a fill hole of an ink cartridge, and a one way valve arrangement to permit fluid to flow through the fill hole into the cartridge, but not thereoutof, the valve arrangement including one or more generally radial openings in the body which connect to the proximal end of the body, and a resilient member located in a recess in the body and surrounding the or each radial opening, the resilient member in a relaxed condition closing the or each radial opening.

2. Apparatus according to claim 1, wherein the body has a pointed distal end to permit the body to penetrate a seal over the fill hole as the body is pushed thereinto.

3. Apparatus according to claim 1, wherein a flange is provided around the proximal end of the body, engageable around the perimeter of the fill hole.

4. Apparatus according to claim 1, wherein a recess is provided in the proximal end of the body to receive a supply member for ink to refill the cartridge.

5. Apparatus according to claim 4, wherein the recess has a Luer slip configuration.

6. Apparatus according to claim 1, wherein the body is dimensioned so as to slidingly sealingly fit in the fill hole.

7. Apparatus according to claim 1, wherein the resilient member is in the form of a sleeve or an O ring.

8. A method of refilling an ink cartridge having a fill hole, the method including locating apparatus according to claim 1 in the fill hole of a cartridge, and passing ink through the apparatus into the cartridge.

9. A method according to claim 8, wherein the ink is supplied to the apparatus at above ambient pressure.

10. A method according to claim 8, wherein the delivery valve of the cartridge is held open during filling to permit air to pass out of the cartridge therethrough.

11. A method according to claim 10, wherein below ambient pressure is applied to the cartridge delivery valve during refilling.

12. A method according to claim 8, wherein the apparatus remains in the fill hole following refilling.

13. A method according to claim 8, wherein the apparatus is used to initially break a seal over the fill hole.

14. A method according to claim 8, wherein the ink is supplied by a syringe, the distal end of which sealingly locates in the recess.

15. A method according to claim 8, wherein the ink is supplied through a feed pipe, the distal end of which sealingly locates in the recess.

* * * * *